US005299916A

United States Patent [19]

Schmid

[11] Patent Number: 5,299,916

[45] Date of Patent: Apr. 5, 1994

[54] LIQUID-RING PUMP HAVING AN OUTLET MEANS INCLUDING A NOISE REDUCING FLEXIBLE MEMBRANE

[75] Inventor: Norbert Schmid, Bad Neustadt, Fed. Rep. of Germany

[73] Assignee: Siemens Aktiengesellschaft, Munich, Fed. Rep. of Germany

[21] Appl. No.: 991,834

[22] Filed: Dec. 16, 1992

[30] Foreign Application Priority Data

Dec. 17, 1991 [DE] Fed. Rep. of Germany ..... 4141674

[51] Int. Cl.[5] ..... F04B 39/00

[52] U.S. Cl. ..... 417/68; 417/312

[58] Field of Search ..... 417/68, 69, 312, 540, 417/542

[56] References Cited

U.S. PATENT DOCUMENTS

| | | | |
|---|---|---|---|
| 1,180,613 | 4/1916 | Siemen | 417/68 |
| 3,366,314 | 1/1968 | Schröder | 417/68 |
| 4,537,567 | 8/1985 | Kawaguchi et al. | 418/63 |
| 4,539,879 | 3/1986 | Uetuji et al. | 417/312 |
| 4,992,028 | 2/1991 | Schoenwald | 417/68 |

FOREIGN PATENT DOCUMENTS

| | | | |
|---|---|---|---|
| 0367845 | 5/1990 | European Pat. Off. . | |
| 2036295 | 1/1972 | Fed. Rep. of Germany | 417/68 |
| 2318538 | 10/1974 | Fed. Rep. of Germany . | |
| 5428 | 1/1980 | Japan | 417/68 |

*Primary Examiner*—Richard A. Bertsch
*Assistant Examiner*—Roland McAndrews, Jr.
*Attorney, Agent, or Firm*—Kenyon & Kenyon

[57] ABSTRACT

The present invention relates to a liquid-ring pump which effectively dampens noise by providing a blocking element arranged in its compression space in the flow path between the mouth of its output port and the outlet opening of its discharge connection. The blocking element covers this outlet opening and has a flow-through opening. The cross-section of the flow-through opening automatically adapts to the quantity of medium delivered by the pump at any given time.

7 Claims, 3 Drawing Sheets

LIQUID-RING PUMP HAVING AN OUTLET MEANS INCLUDING A NOISE REDUCING FLEXIBLE MEMBRANE

BACKGROUND OF THE INVENTION

The present invention relates to a liquid-ring pump and in particular, a liquid-ring pump having improved noise damping at its outlet area.

Such a liquid-ring pump is disclosed by the EP-A-O 367 845. In this liquid-ring pump, a baffle member is arranged in a flow path, which runs from the outlet orifice of a control member toward a discharge connection. The liquid contained in the delivery mixture of the liquid-ring pump is rerouted by the baffle member such that its direction of flow is directed at right angles to the direction of flow of the gas contained in the delivery mixture. In this manner, a liquid film having a sound-damping effect is produced.

The object of the present invention is to develop a liquid-ring pump having improved noise damping in its outlet area.

SUMMARY OF THE INVENTION

The present invention meets the aforementioned objective by providing a liquid-ring pump having a pump housing, an impeller, a control member, a discharge connection and a blocking element. The pump housing defines a compression chamber and rotatably supports the impeller. The control member has an input port and an output port. The output port defines a passage to the compression chamber. The discharge connection is connected to the compression chamber and leads to an area outside of the pump. The blocking element is arranged in the compression space in a flow path between the output port and an outlet opening of the discharge connection. The blocking element covers the outlet opening and has a flow-through opening. The flow-through opening has a cross-section able to automatically adapt to a quantity of the medium delivered by the pump at any given time.

Such a pump has virtually no more free passageway through which noises can pass through, unimpeded, to the outside. The outlet opening of the discharge connection is completely covered by the blocking element. The size of the flow-through opening is adapted based on the delivery volume of the liquid-gas mixture such that it is completely filled by this mixture. Therefore, there is no available path for noises to pass through, not even in the area of the flow-through opening. Moreover, the blocking element divides the compression chamber into two areas. By doing so, a noise-damping effect, similar to that of a cavity resonator, is produced.

The blocking element can be designed as a flat cover part that tightly abuts the peripheral edge of the outlet opening of the discharge connection. Manufacturing such a part is particularly simple.

According to another refinement of the present invention, by providing the blocking element with a thin membrane, e.g., a metal foil or a thin plastic, by forming the blocking element of flexible material, and by configuring at least one flexible tongue (i.e., baffle plate) in the area of the outlet opening of the discharge connection, a particularly simple specific embodiment of the liquid-ring pump is achieved. The flexible tongue can be forced apart by the discharging medium and is formed by a separating cut in the blocking element.

The two intersecting separating cuts on the blocking element provide the flow-through opening with a relatively large cross-section and with a favorable flow shape.

DETAILED DESCRIPTION

Figure 1:
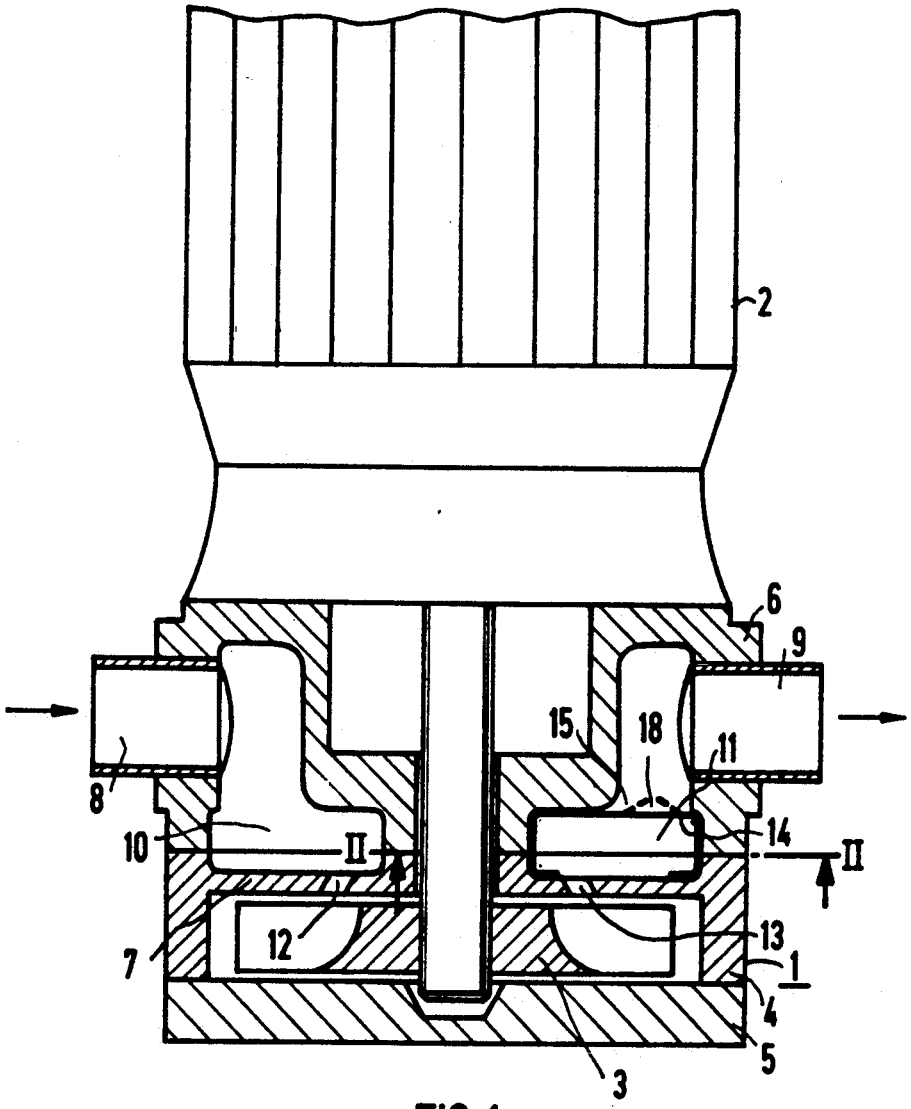
FIG. 1 is a cross-sectional side view of a liquid-ring pump according to the present invention.
Figure 3:
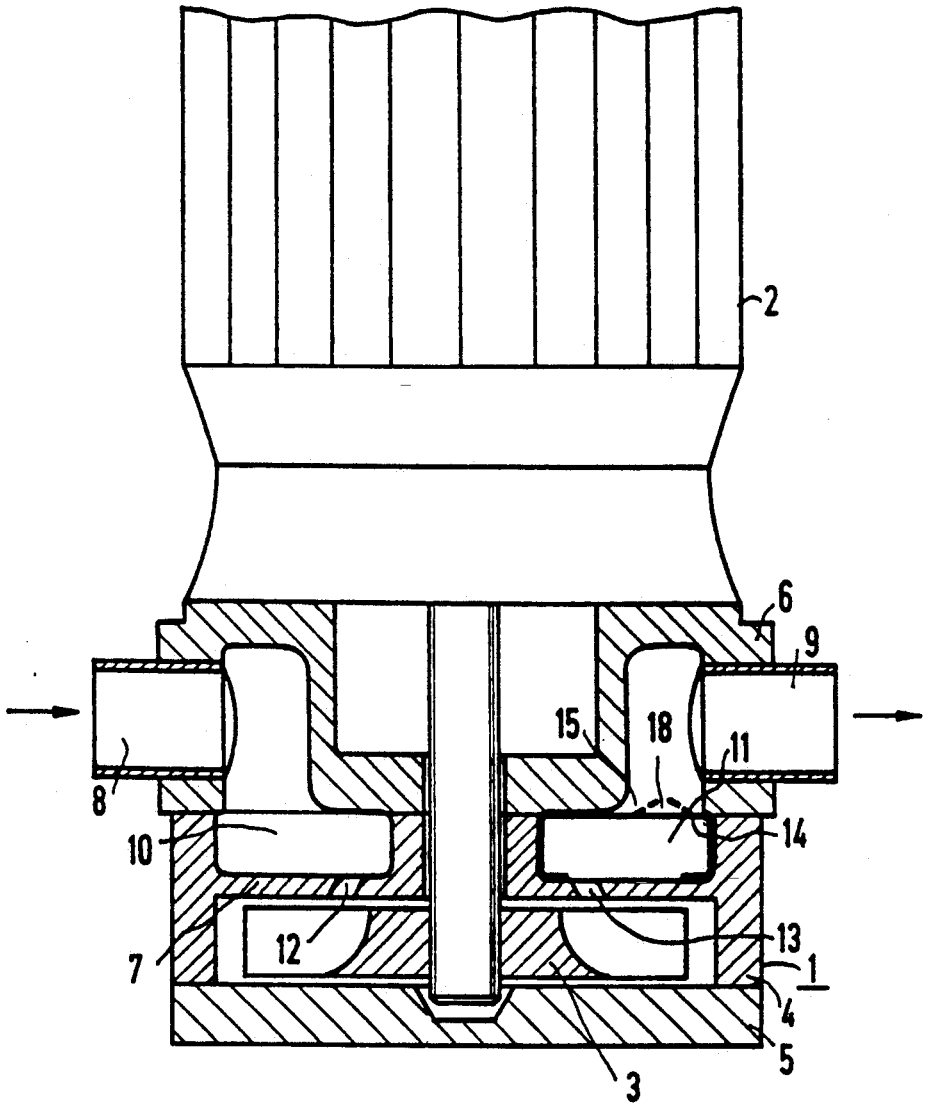
FIG. 3 is a cross-sectional side view of a liquid-ring pump according to an alternative embodiment of the present invention.

FIG. 1 depicts a liquid-ring pump 1 which is flange-mounted onto the housing of a drive motor 2. The liquid-ring pump 1 includes a pump housing 4 that accommodates the impeller 3 of the pump. The pump housing 4 is provided on its one side with a flush end flange 5. A control disk 7, which is integrally formed on the pump housing is configured on the side of the pump housing 4 opposite the end flange 5 and serves as a control member. In an alternate embodiment, the control disk 7 is installed as a separate part between a housing cover 6 and the pump housing 4. Situated on a housing cover 6 are an intake connection 8 and a discharge connection 9. These connections lead into a suction chamber 10 and a compression chamber 11, respectively. The suction chamber 10 and compression chamber 11 may be formed in both the housing cover 6 and the control disk 7 of the pump housing 4 as shown in FIG. 1, or alternatively, only in the control disk 7 of the pump housing as shown in FIG. 3. Cavities in the housing cover 6 and in the pump housing 4 define these chambers. The input port 12 and the output port 13 of the liquid-ring pump are situated on the control disk 7. These ports 12 and 13 are arranged on the control disk 7 such that the input port 12 is in communication with the suction chamber 10 and the output port 13 is in communication with the compression chamber 11. The discharge connection 9 includes an outlet opening 15 which leads into the compression chamber 11.

A blocking element 14 designed from a thin membrane, e.g., a metal foil or a thin plastic, is inserted into the compression chamber 11 such that it completely covers the outlet opening 15. This blocking element 14 can also be designed to cover the side walls of the compression chamber 11 such that the sealing effect of the blocking element 14 is improved.

Figure 2:
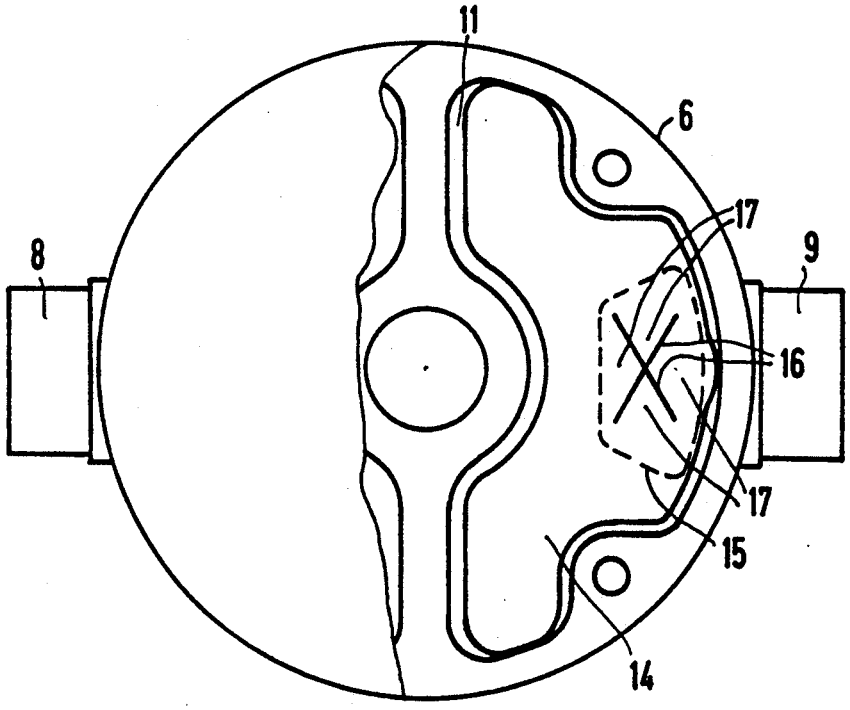
FIG. 2 is a partial cut-away top view of a liquid-ring pump in a section along the line II—II of FIG. 1.

As shown in FIG. 2, two intersecting separating cuts 16 are arranged in the area of the blocking element 14 that covers the outlet opening 15. These separating cuts 16 form four triangular tongues 17. When the liquid-ring pump is operating, the tongues 17 are forced apart under the influence of the medium, for example the liquid-gas mixture, delivered by the pump. This is indicated by the dotted lines in FIG. 1. As a result, a flow-through opening 18 is created. The cross-section of the flow-through opening changes based on the traversing medium such that no free path for noises to pass through exists. As a result, good noise damping is achieved.

This noise damping amounts to over 10 dB, particularly at high liquid-ring-pump suction pressures.

What is claimed is:

1. A liquid-ring pump for delivering a medium comprising:

a) a pump housing, said pump housing defining a compression chamber;

b) an impeller rotatably supported in said pump housing;

c) a control member, having i) an input port, and ii) an output port, said output port defining a passage to said compression chamber;

d) a discharge connection, connected to said compression chamber and leading to an area outside of said pump;

e) a blocking element, i) arranged in said compression chamber in a flow path between said output port and an inlet opening of said discharge connection, ii) covering said inlet opening, and iii) having a flow-through opening, said flow-through opening having a cross-section able to automatically adapt to a quantity of the medium delivered by the pump at any given time, wherein said blocking element is a flexible membrane, and wherein at least one flexible flap is configured in the area of said outlet opening of said discharge connection and said flap is capable of being forced apart by the discharging medium and is formed by a separating cut in said blocking element.

2. The liquid-ring pump of claim 1, wherein two intersecting separating cuts are provided on the blocking element.

3. A liquid-ring pump for delivering a medium comprising:

a) a pump housing, b) a housing cover, said housing cover being fixed over said pump housing and, with said pump housing, defining a compression chamber, said compression chamber having an outlet opening;

c) an impeller rotatably supported by said pump housing;

d) a control member, said control member defining i) an input port, and ii) an output port, said output port defining a passage to said compression chamber;

e) a discharge connection, said discharge connection defining a passage from said compression chamber to an area outside said liquid-ring pump;

f) a blocking element, said blocking element i) being arranged in said compression space in a flow path between said output port and an inlet opening of said discharge connection, ii) covering said inlet opening, and iii) having a flow-through opening, said flow-through opening having a cross-section, said cross-section being automatically adjustable based on a quantity of the medium delivered by the pump at any given time; and g) at least one flexible flap, said flexible flap being configured in an area of said outlet opening, being capable of being forced apart by the discharging medium and being defined by a separating cut in said blocking element, wherein said blocking element is a flexible membrane.

4. The liquid-ring pump of claim 3 wherein said flexible membrane is a metal foil.

5. The liquid-ring pump of claim 3 wherein said flexible membrane is a thin plastic.

6. The liquid-ring pump of claim 3, wherein said separating cut is intersected by a second cut in the blocking element thereby defining said at least one flexible flap.

7. The liquid-ring pump of claim 6 wherein four triangular flexible flaps are defined.

* * * * *